US009376247B2

(12) United States Patent
Dodd

(10) Patent No.: US 9,376,247 B2
(45) Date of Patent: Jun. 28, 2016

(54) RE-SEALABLE CONTAINER

(71) Applicant: Glaxo Group Limited, Brentford, Middlesex (GB)

(72) Inventor: Stephen J. Dodd, Middlesex (GB)

(73) Assignee: Glaxo Group Limited, Brentford, Middlesex (GB)

( * ) Notice: Subject to any disclaimer, the term of this patent is extended or adjusted under 35 U.S.C. 154(b) by 0 days.

(21) Appl. No.: 14/394,823

(22) PCT Filed: Apr. 15, 2013

(86) PCT No.: PCT/EP2013/057802

§ 371 (c)(1),
(2) Date: Oct. 16, 2014

(87) PCT Pub. No.: WO2013/156440

PCT Pub. Date: Oct. 24, 2013

(65) Prior Publication Data

US 2015/0108178 A1 Apr. 23, 2015

(30) Foreign Application Priority Data

Apr. 17, 2012 (GB) ..... 1206707.0

(51) Int. Cl.

| | |
|---|---|
| ***B67D 3/00*** | (2006.01) |
| ***B65D 75/58*** | (2006.01) |
| ***B65D 75/30*** | (2006.01) |
| ***B65D 75/52*** | (2006.01) |
| *B65D 33/16* | (2006.01) |
| *B65D 33/30* | (2006.01) |

(52) U.S. Cl.

CPC ..... *B65D 75/5811* (2013.01); *B65D 75/30* (2013.01); *B65D 75/52* (2013.01); *B65D 33/1616* (2013.01); *B65D 33/1658* (2013.01); *B65D 33/30* (2013.01); *B65D 75/5822* (2013.01); *B65D 2313/02* (2013.01); *B65D 2575/586* (2013.01)

(58) Field of Classification Search

CPC ..... B65D 75/5811; B65D 75/5822; B65D 33/30; B65D 33/1616; B65D 33/1658; B65D 2575/586; B65D 2313/02; B65D 75/30; B65D 75/52

USPC ..... 222/107, 527–530, 541.1, 541.5–541.6

See application file for complete search history.

(56) References Cited

U.S. PATENT DOCUMENTS

| | | | | | |
|---|---|---|---|---|---|
| 1,461,727 | A | * | 7/1923 | Deubener | 229/84 |
| 3,278,085 | A | | 10/1966 | Brown | |
| 4,163,509 | A | * | 8/1979 | Amneus | 222/95 |
| 4,312,689 | A | * | 1/1982 | Amneus | 156/160 |
| 5,228,782 | A | | 7/1993 | Imer | |

(Continued)

FOREIGN PATENT DOCUMENTS

| | | | |
|---|---|---|---|
| DE | 20 2004 000591 | U1 | 3/2004 |
| JP | S58 41059 | A | 3/1983 |

*Primary Examiner* — Frederick C Nicolas

(74) *Attorney, Agent, or Firm* — Alison B. Kessler; Theodore R. Furman

(57) ABSTRACT

A re-sealable flexible sachet (10, 50) with a nozzle portion (14) which is foldable about a fold line (41, 52, 110) to constrict the outlet conduit (15) when the nozzle portion (14) is in the folded configuration, and the nozzle portion (14) has an ear (20A, 20B, 51) extending in a transverse direction with a corresponding slot opening (23A, 23B, 53) to receive the ear (20A, 20B, 51) to secure the nozzle portion (14) when the nozzle portion (14) is in the folded configuration.

8 Claims, 2 Drawing Sheets

(56) References Cited

U.S. PATENT DOCUMENTS 6,244,468 B1 * 6/2001 Farmer et al. ..... 222/107
6,357,631 B1 * 3/2002 Zaksenberg ..... 222/212
2008/0056623 A1 3/2008 Shubilla
2011/0075954 A1 3/2011 Kumar

* cited by examiner

RE-SEALABLE CONTAINER

This application is a 371 of International Application No. PCT/EP2013/057802, filed 15 Apr. 2013, which claims the priority of GB 1206707.0 filed 17 Apr. 2012.

This invention relates to re-sealable containers, in particular to re-sealable sachets.

Sachets are often used for the provision of fluid substances such as medicinal creams and ointments etc. Generally sachets comprise an envelope of flexible material, typically formed by bonding two sheets of the material together around a perimeter that defines a reservoir with an interior volume which contains the fluid substance contents. Typical flexible materials are metal foils and metal foil—plastics material laminates.

Sachets can be opened in various ways for dispensing their contents. For example a part of the sachet can be cut or torn away to provide an outlet orifice. Some sachets are provided with a tear-off closure part which can be torn off to open the outlet orifice. Some sachets are constructed with an elongate outlet nozzle with an internal outlet conduit, with the outlet orifice at the downstream end of the outlet conduit. Typically when the outlet orifice has been opened the fluid content is dispensed by squeezing the sachet to extrude its contents.

A problem with sachets is the need to re-seal the sachet after use, for example after dispensing part of the fluid contents with the intention of dispensing more of the contents subsequently. Such re-sealing can help prevent leakage of contents and/or contamination of the contents. Numerous solutions to this problem are known. For example U.S. Pat. No. 3,278,085 discloses a sachet in which the outlet nozzle can be folded back over the envelope, and provided with tuck-under flaps to retain the nozzle. U.S. Pat. No. 5,228,782 discloses a sachet in which the nozzle can be folded across the envelope and threaded through a slot formed in the envelope. A problem with such sachets is securing the folded down nozzle against inadvertent release and consequent leakage of fluid contents. FR-A-1,016,042 discloses a sachet in which the outlet nozzle can be folded back over the envelope so that the fold closes the outlet conduit, and with a loop to retain the nozzle in its folded configuration. Such a loop disadvantageously requires manufacture from two parts, i.e. the envelope and the loop. US-A-2008/0056623 discloses a flexible walled container with an outlet nozzle which can fold in a single fold to close the outlet nozzle, the outlet nozzle being provided with an ear which can fit into a slit on the container to secure the outlet nozzle in its folded closed state.

It is an object of this invention to provide a container, particularly a sachet, which is re-sealable, and which provides a more secure re-seal after use and improved hygiene in the closed state.

According to this invention a re-sealable container is provided, comprising a reservoir portion for fluid contents and a nozzle portion being made of a flexible material, having an outlet conduit for fluid contents and along which fluid contents can flow in a flow direction downstream from the reservoir portion, and an outlet orifice at a downstream end of the outlet conduit, the nozzle portion being foldable toward the reservoir about a fold line to thereby form a fold in the nozzle portion which constricts the outlet conduit when the nozzle portion is in the folded configuration;

wherein the nozzle portion comprises at least one ear extending from the nozzle portion in a direction transverse to the flow direction, and the container comprises at least one corresponding slot opening into which the ear can be received when the nozzle portion is in the folded configuration to thereby retain the nozzle portion in the folded configuration.

The container is suitably a sachet container, being made of a flexible material.

Such a sachet container may be made of materials conventional in the field of sachets, for example above-mentioned metal foil or plastics-metal foil laminates. The sachet may be of otherwise conventional construction comprising two sheets of the sheet-form flexible material joined together at seams, e.g. by welding or adhesive, around the edges of the sachet, with areas which are not so joined together defining the interior volume of the reservoir and the outlet conduit.

The nozzle portion is suitably in the form of an elongate tube extending in the flow direction and along which the fluid content may flow downstream. Suitably the outlet orifice of the outlet conduit is closed prior to dispensing of the contents by means of a closure, for example a conventional tear-off closure portion.

Preferably the nozzle portion can fold toward the reservoir about a fold line aligned transverse to, preferably perpendicular to the flow direction. Such a construction can provide a compact sachet as the nozzle can fold flat onto the reservoir portion.

The reception of the ear in the slot opening is such as to assist in retaining the nozzle portion in the folded configuration, and the presence of the fold in the nozzle obstructs flow of contents out through the nozzle and entry of contaminants from the environment into the nozzle.

The ear suitably comprises one or more layers of the flexible material of the nozzle portion joined e.g. laminated together in the same manner as the seams.

In a first embodiment the ear extends from an edge of the nozzle portion, preferably in a direction generally perpendicular to the flow direction. In this embodiment the ear is suitably located further in the downstream direction from the slot opening, so that the nozzle portion can be folded about a fold line transverse to, preferably perpendicular to, the flow direction which is between the ear and the slot opening. Preferably the ear and the corresponding slot opening are disposed on opposite sides of the fold line. Suitably a crease may be made in the material of the nozzle portion between the ear and the slot, extending in the transverse direction across the nozzle portion to encourage the nozzle portion to fold at this line, and positioned such that when the neck portion folds about this crease the ear is adjacent to the slot opening. With the nozzle portion in its folded configuration the ear can be received by the slot opening to retain the nozzle portion in its folded configuration with the fold constricting flow through the conduit.

In a particularly preferred form of this first embodiment there are two ears and two corresponding slot openings, preferably having the respective above-described features, the respective ears and slots extending in opposite directions from the nozzle portion, preferably being symmetrically opposite each other across a longitudinal line aligned with the flow direction. The provision of two such ears and corresponding slot openings facilitates the retention of the nozzle portion in the folded configuration.

In a second embodiment of the invention the ear extends from an edge of the nozzle portion, in a direction transverse to, preferably generally perpendicular, to the flow direction, this ear is foldable across the nozzle portion about a fold line generally parallel to the flow direction, the ear is of such length that it can be folded across the neck portion, preferably all the way across, and the slot opening is located opposite the ear across the flow direction so that the ear can be received by the slot opening when it is in the folded configuration.

In this embodiment the nozzle portion can be folded about a fold line transverse to, preferably perpendicular to, the downstream direction, and located downstream from the ear and slot opening. As in the first embodiment above suitably a crease may be made in the material of the nozzle portion to encourage the nozzle portion to fold at this crease. In this second embodiment the ear and the slot opening are on the same side of the fold line. With the nozzle portion folded down, the ear may be folded over the folded-down part of the nozzle portion and threaded through the slot opening to thereby retain the neck portion in the folded-down configuration.

The slot opening may be located in a part of the nozzle portion or the reservoir portion, e.g. a part of the reservoir portion adjacent to the nozzle portion.

The slot opening is elongate and corresponds generally to the sectional shape of the ear. Suitably the elongate direction of the slot is aligned generally parallel to the flow direction. Suitably the long edge of such a slot closest to the outlet conduit is located at the same distance or further in the direction transverse to the downstream direction than is the part of the edge of the nozzle portion from which the ear extends. Such an arrangement facilitates the receiving of the ear by the slot opening.

The dimensions of the ear in the flow direction should be such that the ear can be received as fully as practical by the slot. For example the greatest dimension of the ear in the flow direction should be no greater than the longest dimension of the slot opening. However the dimensions of the ear in the flow direction may be greater than the longest dimension of the slot opening to enable the ear to fit more tightly within the slot opening by means of wedging of the ear within the slot, or the expansive resilience of the ear within the slot opening causing the ear to press against the edge of the slot opening.

Preferably the ear tapers in the direction in which it extends transverse to the flow direction, e.g. being in a triangular or a tapering shape with one or more curved edge. A tapering shape can facilitate inserting the ear into the slot opening.

Preferably at least one edge of the ear is of a concave shape. Such a concave shape edge can engage with the edge of the slot opening when the ear is received in the slot opening and can help to retain the ear in the slot. Such a concave shape may for example comprise a concave notch in the edge of the ear, for example adjacent to the part of the nozzle portion from which the ear extends. In an embodiment such a notch may be located in the edge of the ear which in the unfolded state of the outlet nozzle faces away from the outlet orifice.

Advantageously in an embodiment the nozzle portion may be long enough in the downstream direction beyond the ear that the nozzle portion is foldable toward the reservoir about a first fold line to thereby form the above-mentioned fold in the nozzle portion which constricts the outlet conduit when the nozzle portion is in the folded configuration, and is also foldable about a second fold line to form a second fold between the first fold and the outlet orifice which can further constrict the outlet conduit between the first fold and the outlet orifice. Preferably the nozzle portion is long enough that when such a second fold is made the part of the nozzle portion between the second fold and the outlet orifice may be tucked under the part of the nozzle portion between the second fold and the first-mentioned fold.

The present invention therefore provides such a container, e.g. a sachet, in which in its closed configuration the neck portion is folded toward the reservoir at a first fold, and the neck portion is also folded at a second fold between the first fold and the outlet orifice. Suitably in its closed configuration the part of the neck portion between the second fold and the outlet orifice is tucked under a part of the neck portion between the first and second folds. Preferably the length of the part of the neck portion between the second fold and the outlet orifice is sufficient to enable the part to be tucked under securely. For example the length of the part of the neck portion between the second fold and the outlet orifice may be 50% or more, e.g. 75% or more of the length of the part of the nozzle portion between the first and second folds to facilitate this.

Preferably to encourage such first and second folds, in this embodiment the nozzle portion includes a first crease between the ear(s) and the slot(s), and a second crease between the first crease and the outlet orifice. Preferably the second crease is between the ear(s) and the outlet orifice. To achieve the advantageous tucking-under referred to above, preferably the length of the part of the neck portion between the second crease and the outlet orifice may be 50% or more, e.g. 75% or more of the length of the part of the nozzle portion between the first and second creases to facilitate this.

The presence of this second fold can improve the closing of the nozzle portion by interposing this second fold between the outlet orifice of the nozzle portion and the interior of the sachet, and can improve the hygiene of the re-sealing by tucking the outlet orifice of the nozzle portion under a portion of the nozzle portion to thereby isolate it from the environment.

To further protect the outlet orifice from the environment in this last embodiment, the length of the nozzle portion and the position of the ear(s) may be such that when the nozzle portion is in its tucked-under position and the ear(s) is received by the slot, the ear(s) is/are adjacent to the outlet orifice of the nozzle. In such a configuration the ear serves to further cover the outlet orifice, and may be made of a convenient size to facilitate this.

The container, e.g. sachet of this invention may be used for the containment and dispensing therefrom of all kinds of viscous fluid products in the form of mobile liquids, gels, pastes etc. Such products may for example be healthcare products such as toothpastes, creams, ointments etc., food products, paints or dyes, adhesives etc.

The invention will now be described by way of example only with reference to the accompanying drawings.

BRIEF DESCRIPTION OF THE DRAWINGS

Referring to FIGS. 1, 2 and 3 a re-sealable sachet container is shown overall 10, made of a flexible plastics-metal foil laminate material. Sachet 10 comprises a reservoir portion 11 for fluid contents, formed by defining an internal volume 12 bounded by a seam 13 formed by joining two sheets of the laminate material together with a weld, in a conventional manner. The sachet 10 also comprises a nozzle portion 14 in the form of an elongate tube integrally made of the same flexible material as the sachet 10 extending in the flow direction having an internal outlet conduit 15 defined between seams 16 for fluid contents and along which fluid contents can flow in a downstream flow direction indicated by the arrow from the reservoir portion 11, and an outlet orifice 17 at a downstream end of the outlet conduit 15.

As seen in FIG. 1 the outlet orifice 17 of the outlet conduit 15 is closed prior to dispensing of the contents of the reservoir portion 12 by means of a conventional tear-off closure portion 18. As seen in FIG. 2 this closure portion has been torn away at a pre-formed tear line 19 to open the sachet 10.

Figure 1:
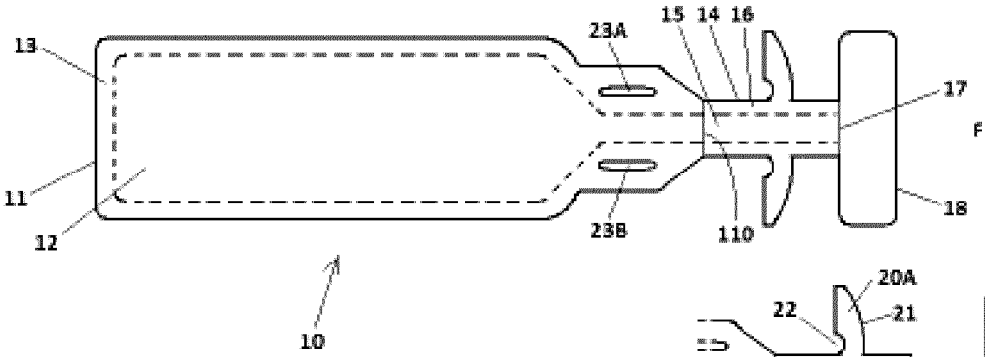
FIG. 1 shows a plan view of a sachet of this invention in an initial closed configuration.
Figure 2:
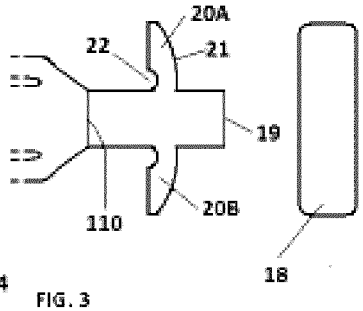
FIG. 2 shows a plan view of the sachet of FIG. 1 in an open configuration.

On each side of the nozzle portion 14 of the sachet 10 an ear 20A, 20B extends from the nozzle portion 14 in a direction transverse to the flow direction. Each ear 20A, 20B comprises one or more layers of the flexible material of the sachet 10 laminated together in the same manner as the seams 13, 16. In this way the ears 20A, 20B are integrally made with the sachet 10. The shape of each ear 20A, 20B tapers in the direction transverse to the flow direction, being in a tapering shape with a curved downstream edge 21. The edge of each ear 20A, 20B furthest from the outlet orifice 17 in the non-folded state of the outlet nozzle incorporates a concave notch 22 adjacent to the part of the nozzle portion 14 from which the ear 20A, 20B extends.

In the sachet 10 and located further upstream along the nozzle portion 14 from the outlet orifice 17 than is the ear 20A, 20B, is a slot opening 23A, 23B. Each slot opening 23A, 23B is elongate with its elongate direction aligned parallel to the flow direction, and the shape of each slot opening 23A, 23B corresponds generally to the sectional shape of the ears 20A, 20B.

Figure 3:
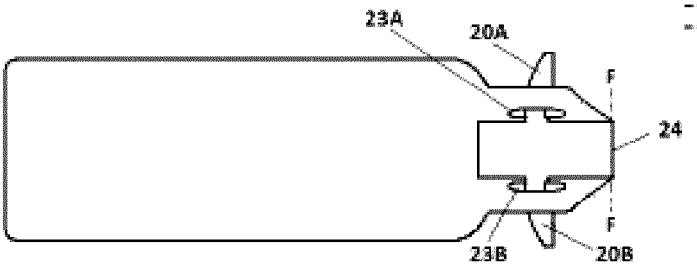
FIG. 3 shows a plan view of the sachet of FIGS. 1 and 2 in a re-sealed configuration.

As can be seen in FIG. 3 the nozzle portion 14 is foldable at crease 110 made in the material of the nozzle portion 14 in a direction transversely across its length, toward the reservoir portion 11 about a fold line F-F aligned perpendicular to the flow direction to thereby form a fold 24 in the nozzle portion 14 which constricts the outlet conduit 15 when the nozzle portion 14 is in the folded configuration shown in FIG. 3. In this configuration the nozzle portion 14 folds flat onto the sachet 10 in a compact arrangement.

As can be seen in FIG. 3 when the nozzle portion 14 is in the folded configuration each ear 20A, 20B can be inserted into a respective slot opening 23A, 23B. The tapered shape of the ears 20A, 20B facilitate inserting the ears 20A, 20B into the slot opening. The long edge of each slot 23A, 23B closest to the outlet conduit is located at the same distance in the direction transverse to the downstream direction than is the part of the edge of the nozzle portion 14 from which the ear 20A, 20B extends. The greatest dimension of the ear 20A, 20B in the flow direction is less than the longest dimension of the slot opening 23A, 23B so that the ear 20A, 20B can fit as far as possible into the slot 23A, 23B. The concave notch 22 engages with the edge of the slot opening 23A, 23B when the ear 20A, 20B is received in the slot opening 23A, 23B. Such construction features facilitate retention of the ear 20A, 20B in the slot opening 23A, 23B.

Figure 4:
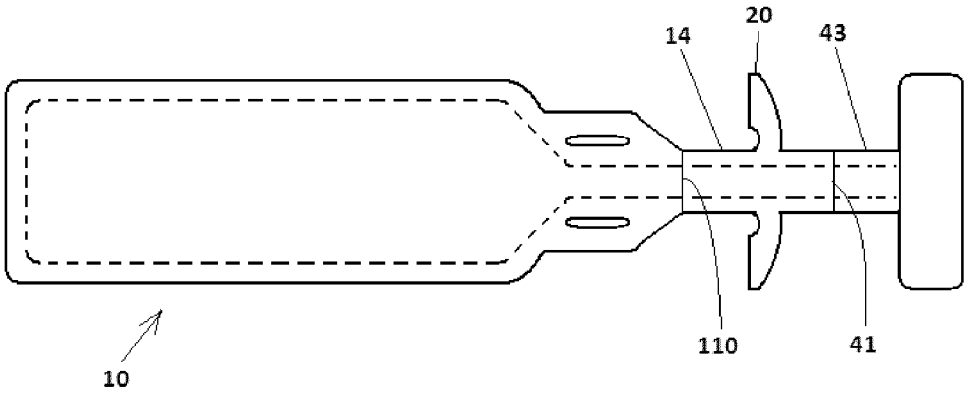
FIG. 4 shows a plan view of another sachet of this invention in an initial closed configuration.
Figure 5:
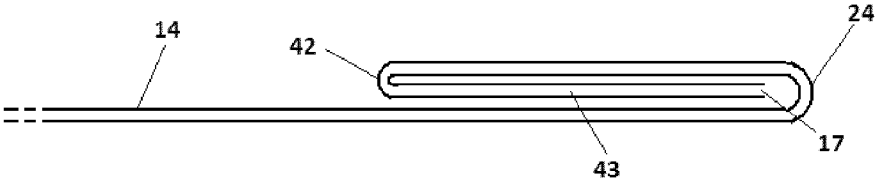
FIG. 5 shows a side view of the nozzle portion of the sachet of FIG. 4.

FIGS. 4 and 5 show a further embodiment of sachet 10 in which the nozzle portion 14 is long enough in the downstream direction beyond the ears 20 that a second crease 41 is made between the ears 20 and the outlet orifice 17. As seen in FIG. 5 the nozzle portion 14 can be folded at crease 110 shown in FIG. 4, analogous to FIG. 1, to create a first fold 24 as in FIG. 3, and also at crease 41 to form a second fold 42 in the nozzle portion 14. This second fold 42 further constricts the outlet conduit 15 between the ears 20 and the outlet orifice 17, and also as seen in FIG. 5 the part 43 of the nozzle portion 14 between the second fold 42 and the outlet orifice 17 can be tucked under the part of the nozzle portion 14 between the second fold 42 and the first fold 24. It is seen in FIG. 5 that the part 43 is almost as long as the part of the nozzle portion between the first and second folds 24, 42 so that the outlet nozzle 17 is securely covered by the part of the nozzle portion between the first and second folds 24, 42.

Figure 6:
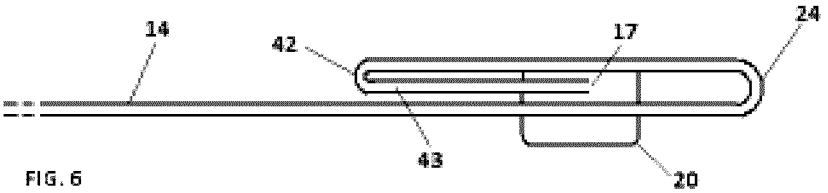
FIG. 6 shows a modification to the side view of FIG. 5

FIG. 6 shows a modification of the construction shown in FIG. 5 in which the size and position of the ear 20 is such that with the part 43 of the nozzle portion 14 tucked under the part of the nozzle portion 14 between the first 24 and second 42 folds, with the ear 20 received by the slot (not shown), the ear 20 is adjacent to the outlet orifice 17, so that the ear 20 serves to further enclose the outlet orifice 17 to further protect the outlet orifice 17 from the environment.

Figure 7:
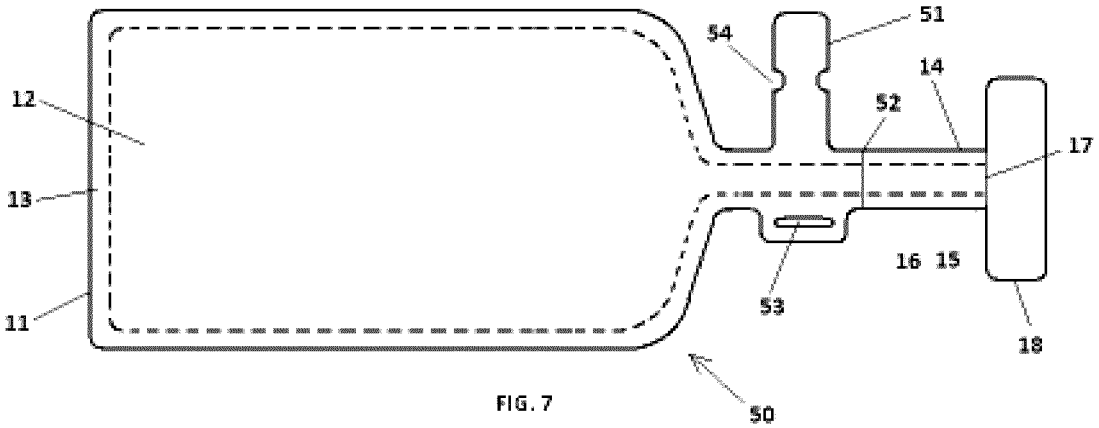
FIG. 7 shows a plan view of another embodiment of a sachet of this invention in an initial closed configuration.

FIG. 7 shows overall 50 another embodiment of the sachet of this invention. Parts of the sachet corresponding to FIGS. 1-4 are numbered correspondingly. In the sachet 50 overall of FIG. 7 the ear 51 extends from an edge of the nozzle portion 14 in a direction perpendicular to the flow direction. Ear 51 is foldable across the nozzle portion 14 about a fold line defined by crease 52 generally parallel to the flow direction. Ear 51 is of such length that it can be folded all the way across the neck portion 14. A slot opening 53 is located opposite the ear 51 across the flow direction so that the ear 51 can be received by the slot opening 52 when it is in the folded configuration. The ear 51 and slot opening 53 are on the same side of the crease 52.

In the embodiment of FIG. 7 the nozzle portion 14 can be folded analogously to the embodiment of FIGS. 1-6 about a fold line F-F perpendicular to the flow direction, and located downstream from the ear 51 and slot opening 53. The crease 52 made in the material of the nozzle portion 14 encourages the nozzle portion 14 to fold at this point. With the nozzle portion 14 folded down onto the sachet 50, the ear 51 may be folded over the folded-down part of the nozzle portion 14 and threaded through the slot opening 53 to thereby retain the neck portion 14 in the folded-down configuration.

In the embodiment of FIG. 7 the greatest dimension of the ear 51 in the flow direction is slightly greater than the length of the slot opening 53, so that resilience of the ear 51 within the slot opening 53 assists retention of the ear 51 in the slot opening. Notches 54 are also provided in the edges of the ear 51 to assist retention of the ear 51 in the slot opening 53.

As with the embodiment of FIGS. 4 and 5, the nozzle portion 14 may be long enough to allow a second crease (not shown in FIG. 7) to be present in the part of the nozzle portion between ear 51 and the outlet orifice 17.

The invention claimed is:

1. A re-sealable sachet container, being made of a flexible material, comprising a reservoir portion for fluid contents and a nozzle portion being made of a flexible material, having an outlet conduit defined by said nozzle portion for the fluid contents and along which the fluid contents can flow in a flow direction downstream from the reservoir portion, and an outlet orifice at a downstream end of the outlet conduit, wherein an ear extends from an edge of the nozzle portion in a direction transverse to the flow direction, the ear is foldable across the nozzle portion about a fold line generally parallel to the flow direction, the ear being of such a length that the ear can be folded about the fold line all the way across the neck portion, a slot opening is located opposite the ear across the flow direction so that the ear can be received by the slot opening when the ear is in the folded configuration, the nozzle portion can be folded toward the reservoir down onto the sachet about the fold line transverse to the downstream direction and located downstream from the ear and slot opening to thereby form a fold in the nozzle portion which constricts the outlet conduit when the nozzle portion is in the folded configuration, and with the nozzle portion folded down onto the sachet, the ear is foldable over the folded-down part of the nozzle portion and threadable through the slot opening to thereby retain the nozzle portion in the folded-down configuration.

2. A re-sealable sachet container according to claim 1 wherein the nozzle portion is in the form of an elongate tube extending in the flow direction and along which the fluid contents in the reservoir may flow downstream.

3. A re-sealable sachet according to claim 1 wherein the slot opening is elongate with a long dimension of the slot opening is aligned generally parallel to the flow direction and corresponds generally to a sectional shape of the ear.

4. A re-sealable sachet according to claim 1 wherein the greatest dimension of the ear in the flow direction is no greater than the longest dimension of the slot opening.

5. A re-sealable sachet container according to claim 1 wherein the ear tapers in the direction in which the ear extends transverse to the flow direction.

6. A re-sealable sachet container according to claim 1 wherein at least one edge of the ear is of a concave shape.

7. A re-sealable sachet container according to claim 6 wherein the concave shape comprises a concave notch in the edge of the ear adjacent to the part of the nozzle portion from which the ear extends.

8. A re-sealable sachet container according to claim 1 wherein the nozzle portion is long enough in the downstream direction beyond the ear that a second fold may be made between the ear and the outlet opening to further constrict the outlet conduit between the ear and the outlet opening.

* * * * *